US010629992B2

(12) United States Patent
Shah et al.

(10) Patent No.: US 10,629,992 B2
(45) Date of Patent: Apr. 21, 2020

(54) ANTENNA SYSTEM FOR MATCHING AN IMPEDANCE

(71) Applicant: RELIANCE JIO INFOCOMM LIMITED, Mumbai (IN)

(72) Inventors: Brijesh Ishvarlal Shah, Navi Mumbai (IN); Kailash Kashyap, Navi Mumbai (IN); Praveen Kumar Penta, Navi Mumbai (IN); Vijay Mohan Verma, Navi Mumbai (IN)

(73) Assignee: RELIANCE JIO INFOCOMM LIMITED, Mumbai, Maharashtra (IN)

( * ) Notice: Subject to any disclaimer, the term of this patent is extended or adjusted under 35 U.S.C. 154(b) by 251 days.

(21) Appl. No.: 15/659,416

(22) Filed: Jul. 25, 2017

(65) Prior Publication Data

US 2018/0034157 A1 Feb. 1, 2018

(30) Foreign Application Priority Data

Jul. 26, 2016 (IN) ..... 201621025573

(51) Int. Cl.

| | |
|---|---|
| ***H01Q 9/04*** | (2006.01) |
| ***H01Q 1/38*** | (2006.01) |
| ***H01Q 5/335*** | (2015.01) |
| ***H01Q 1/52*** | (2006.01) |

(52) U.S. Cl.

CPC ..... *H01Q 9/0421* (2013.01); *H01Q 1/38* (2013.01); *H01Q 1/52* (2013.01); *H01Q 5/335* (2015.01)

(58) Field of Classification Search

CPC ..... H01Q 19/0421; H01Q 5/335; H01Q 1/38; H01Q 1/52

See application file for complete search history.

(56) References Cited

U.S. PATENT DOCUMENTS

| | | | | |
|---|---|---|---|---|
| 5,926,150 | A * | 7/1999 | McLean | G01R 29/0821 343/700 MS |
| 2011/0025575 | A1* | 2/2011 | Niederkorn | H01Q 1/243 343/841 |
| 2012/0065946 | A1* | 3/2012 | Brown | H01Q 1/00 703/1 |

(Continued)

*Primary Examiner* — Dameon E Levi
*Assistant Examiner* — David E Lotter
(74) *Attorney, Agent, or Firm* — Ladas & Parry, LLP

(57) ABSTRACT

Embodiments of the present invention relate to an antenna [100] for matching an impedance between a feed point [140] and a radiator [110], comprising: the radiator [110] mounted, over a printed circuit board, has a first end and a second end; a flare [130] for matching the impedance, wherein the flare [130] has a first end and a second end, and the flare [130] is taper-shaped from the first end to the second end of the flare [130]; the feed point [140] comprises a first end and a second end, wherein the first end of the feed point [140] is connected to the second end of the flare [130], and the second end of the feed point [140] is connected to the printed circuit board; and a shorting stub [150] placed between the flare [130] and the printed circuit board for grounding a capacitance induced by the antenna [100].

13 Claims, 11 Drawing Sheets

(56) References Cited

U.S. PATENT DOCUMENTS

| | | | | |
|---|---|---|---|---|
| 2015/0326071 | A1* | 11/2015 | Contopanagos ..... | H01Q 5/364<br>307/104 |
| 2016/0013560 | A1* | 1/2016 | Daniels ..... | H01Q 1/243<br>343/700 MS |

* cited by examiner

ANTENNA SYSTEM FOR MATCHING AN IMPEDANCE

CROSS-REFERENCE TO RELATED APPLICATION

This application claims the priority of the Indian patent application No. 201621025573 filed on Jul. 26, 2016, which is incorporated herein by reference.

TECHNICAL FIELD

Embodiments of the present invention generally relate to antenna systems. More particularly, embodiments of the present invention relate to an antenna system for operating in multiple frequency bands for matching impedance.

BACKGROUND

This section is intended to provide information relating to the general state of the art and thus any approach/functionality described below should not be assumed to be qualified as a prior art merely by its inclusion in this section.

The advancement in the fields of electronics and communication, signal processing, antenna theory and information theory, have contributed to an enormous growth of wireless communication systems. However, despite the tremendous advancement in each of these fields, the desire for improved wireless communication systems has not been reduced. The antenna system being one of the fundamental area of the wireless communication systems demands a perpetual improvisation for effective transmission and signalling.

The antenna system is an electrical device which converts electric power into radio waves and vice versa. The antenna system is usually used with a radio transmitter or radio receiver. In radio transmission system, a radio transmitter supplies an electric current oscillating at a particular radio frequency to a terminal of the antenna system, and the antenna radiates the energy from the current as electromagnetic waves (i.e. radio waves). In a radio reception system, the antenna intercepts some of the power of the electromagnetic wave in order to produce a tiny voltage at its terminals that is applied to a receiver to be amplified to receive the signals. The antenna consists of material that conducts electricity arranged in such a way that it is in harmony with a frequency of a radio signal.

In today's scenario, an antenna is used in almost each of the wireless communication systems. Further, the strong growth in RFID devices suggests to one to several antennas per object (i.e. product, container, pet, banana, toy, cd, etc.). Several other devices including smartphones, wearable devices, smart-watches, smart bands, wearable augmented devices, etc. also use the antenna system for transmission and/or reception of the radio waves. The smartphone is an example of a mobility wireless cellular connectivity device that allows end users to use services on 2G, 3G or 4G mobile broadband Internet connections with multiple advanced antenna system. In such device, the antenna system plays a crucial role in transmission of signals and can have multiple antennas system like global positing system antenna, diversity cell antenna, high band arm antenna, low band arm antenna, transmit/receive antenna (dual band inverted-F antenna) antenna, etc.

While designing the antenna, different factors and design criteria are considered, specifically the size or form factor of the wireless communication devices that poses the major challenge in designing the antenna because of tightly packaged radio frequency (RF) circuitry. Other factors such as portability, efficiency, wide bandwidth of operation and better signal quality also play an important role in designing the antenna. In the current scenario of antenna designing system, a survey of various antenna designs was performed to understand the existence of any wireless antenna design that meets not only the same form factor of LTE antenna design system but also supports existing 2G and 3G devices for achieving high data rate but none of them were not available. In particular, the existing antenna design systems found during the survey occupies large footprint on the PCB and neither of them have removed the existing constrains in the existing antenna design system. In addition, the existing antenna design is affected due to the nearby on-board metal structures including an active and/or a passive components or RF shield.

In addition, the performance of the existing antenna system present inside the wireless device gets affected by the nearby on-board metal components such as subscriber identity module (SIM) connector, RF shield, USB connectors and the material of mechanical housing. This effects performance of the existing antenna system by shifting the existing antenna system's operating frequency and radiation pattern which becomes directional resulting in the reduced device coverage.

Hence, there is a need in the art to provide a better antenna system that occupies minimal footprint on the PCB and reduces interference between nearby on-board metal components that seamlessly allow the communication.

SUMMARY

This section is provided to introduce certain aspects of the present invention in a simplified form that are further described below in the detailed description. This summary is not intended to identify the key features or the scope of the claimed subject matter.

Embodiments of the present invention may relate to an antenna for matching an impedance between a feed point and a radiator, the antenna, comprising: the radiator mounted over a printed circuit board for one of receiving and transmitting a radio signal, wherein the radiator has a first end and a second end, and the length of the radiator determines an operating frequency of the antenna; a flare placed at one of the first end and the second end of the radiator for matching impedance, wherein the flare has a first end and a second end, and the flare is taper-shaped from the first end to the second end of the flare; the feed point comprises a first end and a second end, wherein the first end of the feed point [140] is connected to the second end of the flare [130], and the second end of the feed point is connected to the printed circuit board; and a shorting stub placed between the flare and the printed circuit board for grounding a capacitance induced by the antenna.

Embodiments of the present invention may further relate to a method for manufacturing an antenna [100] for impedance matching, the method comprises: creating a virtual model of the antenna [100], wherein the antenna [100] has a radiator [110], a limb [120], a flare [130], a feed point [140], and a shorting stub [150] connected integrally with each other, and each of the radiator [110], the limb [120], the flare [130], the feed point [140], and the shorting stub [150] have an associated dimension; selecting a metal sheet in accordance with the associated dimension of the virtual model; processing the metal sheet in accordance with the associated dimension of the virtual model wherein the processing includes at least one of a punching, etching, cutting and shaping the metal sheet; and bending at least one curve point of the metal sheet with respect to the associated dimension of the virtual model to produce the antenna [100].

BRIEF DESCRIPTION OF THE DRAWINGS

The accompanying drawings, which are incorporated herein, and constitute a part of this disclosure, illustrate exemplary embodiments of the disclosed methods and systems in which like reference numerals refer to the same parts throughout the different drawings. Components in the drawings are not necessarily to scale, emphasis instead being placed upon clearly illustrating the principles of the present invention. Also, the embodiments shown in the figures are not to be construed as limiting the invention, but the possible variants of the system according to the invention are illustrated herein to highlight the advantages of the invention.

Figure 1:
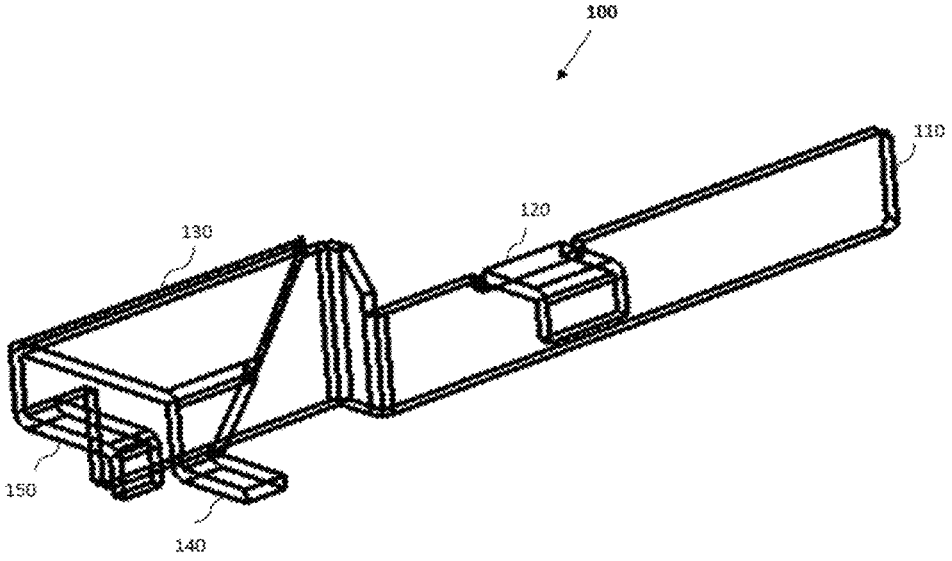
FIG. 1 illustrates an exemplary antenna [100] for matching an impedance between a feed point [140] and a radiator [110], in accordance with an embodiment of the present invention.

It may be evident to skilled artisans that mechanical components in the figures are only illustrative, for simplicity and clarity, and have not necessarily been drawn to scale. For example, the dimensions of some of the mechanical components in the figures may be exaggerated relative to other components to help to improve understanding of embodiments of the present invention.

DETAILED DESCRIPTION

In the following description, for the purposes of explanation, various specific details are set forth in order to provide a thorough understanding of embodiments of the present invention. It will be apparent, however, that embodiments of the present invention may be practiced without these specific details or with additional details that may be obvious to a person skilled in the art. Several features described hereafter can each be used independently of one another or with any combination of other features. An individual feature may not address any of the problems discussed above or might address only one of the problems discussed above. Some of the problems discussed above might not be fully addressed by any of the features described herein. Example embodiments of the present invention are described below, as illustrated in various drawings in which like reference numerals refer to the same parts throughout the different drawings.

Embodiments of the present invention relate to systems and methods that may provide optimum matching of impedance between a feed point [140] and a radiator [110] of the antenna [100], without requiring any additional passive components. Further, an embodiment may relate to a method and a system that enables the antenna [100] to radiate in an omni-directional radiation pattern despite the presence of an on-board nearby metal objects of the printed circuit board.

The present invention also encompasses a method for fabricating and/or manufacturing the antenna [100].

The antenna [100] as used herein include Flared Fed Inverted F Antenna (FFIFA) antenna.

As illustrated in FIG. 1, the present invention illustrates an exemplary antenna [100] for optimum matching of impedance between a feed point [140] and a radiator [110], in accordance with an embodiment of the present invention, the system [100] comprising: a radiator [110], a limb [120], a flare [130], a feed point [140], and a shorting stub [150]. The specifics of the antenna [100] are explained hereinafter.

The radiator [110] may be configured to operate at a variable wireless band. In an embodiment, the radiator [110] may operate at any frequency band of wireless technology. In a preferred embodiment, the radiator [110] may operate at variable wireless band. The radiator [110] may be further configured to one of receive and transmit the radio signals from the air medium. The radiator [110] may comprise a first end and a second end and may be mounted over and along a longitudinal length of the printed circuit board. Further, the radiator [110] may be of quarter-wavelength resonant structure enabling a specific operating frequency; however, the operating frequencies of the antenna [100] may be varied depending on a resonant path length of the radiator [110]. In another embodiment, the radiator [110] may have a length of 0.2-0.3λ.

The flare [130] may be placed at one of the first end and the second end of the radiator for matching impedance. The flare [130] may comprise a first end and a second end wherein the flare [130] may be a taper-shaped from the first end to the second end of the flare [130]. The dimension of the flare [130] may be tuned with respect to the position and a feeding location of the antenna [100] on the printed circuit board. Further, in a preferred embodiment, the flare [130] may be a single-sided flare. The flare [130] may be increased progressively at only one side of the flare [130] from the 50Ω feed point [140] to the radiator [110], thus resulting in the taper-shaped of the flare [130]. Moreover, the taper-shaped may include one of a linear and a non-linear decrease in a width from the first end of the flare [130] to the second end of the flare [130]. In another embodiment, the flare [130] may have a length of 0.04λ.

The feed point [140] may comprise a first end connected to the second end of the flare [130] and a second end connected to the printed circuit board. The flare [130] may match the impedance of the radiator [110] to the 50Ω feed point [140] using the flare [130]. In a preferred embodiment, the feed point [140] may be of approximate dimension of 1.5 mm×2 mm. The antenna [100] encompasses an impedance matching process that may include an impedance matching method wherein a small entity may be added to the geometry of the antenna [100] instead of lumped element usage where the lumped element usage may result in degradation of performance of the antenna [100]. Further, the feed point [140] may be provisioned on a top layer of the printed circuit board, thus, the feed point [140] may be soldered on the printed circuit board. The antenna [100] along with other assembled metal components like USB connector, RF shields, SIM card holder on the printed circuit board may be enclosed by a plastic housing. In an embodiment, the plastic casing may be made up of acrylonitrile butadiene styrene (ABS) having dielectric constant (εr)=3.5 that may provide dimensional stability and toughness for the antenna [100] present in a wireless device. In another embodiment, the feed point [140] may have a length of 0.01λ. The limb [120] may have a first end connected to the radiator [110] and may have a second end connected to the printed circuit board. Further, the limb [120] may be configured to provide a mechanical stability to the antenna [100].

Further, the limb [120] may be a small protruded metal point and may be provided to flank the antenna [100] with the printed circuit board, thereby may improve the mechanical stability by soldering onto the printed circuit through provisioned oval shaped. In a preferred embodiment, the limb [120] may have dimensions of 2.4 mm×0.7 mm. The optimized length is about 0.02λ which apparently adds unintended capacitance. The position, a width and a length of the limb [120] may be tuned to provide the mechanical stability and may add substantial inductance to the antenna [100]. In another embodiment, the limb [120] may have a length of 0.02λ.

The shorting stub [150] may be placed between the flare [130] and the printed circuit board. In a preferred embodiment, the shorting stub [150] may have a first end and a second end. The shorting stub [150] may be configured to ground a capacitance induced by the antenna [100]. The shorting stub [150] may be configured to tune the capacitance effect caused by the antenna [100] with respect to the top copper layer of the printed circuit board and the limb [120]. The shorting stub [150] may be grounded by soldering on a plane of the printed circuit board. In a preferred embodiment, the shorting stub [150] may have a dimension of 1.5 mm×1 mm. In another embodiment, the shorting stub [150] may have a length of 0.03λ.

The antenna [100] may be placed at any portion of a printed circuit board and therefore, occupy a very small footprint area on the printed circuit board of the wireless device. Further, the antenna [100] may be placed along a longitudinal length of the printed circuit board. In an alternative embodiment, the antenna [100] may also be placed along a width of the printed circuit board.

The present invention also encompasses the antenna [100] being mounted over the printed circuit board. In a preferred embodiment, the feed point [140], the limb [120] and the shorting stub [150] may have physical connection to the printed circuit board by a soldering process. The rest of the components such as the radiator [110] and the flare [130] may not have physical connection to the printed circuit board and may be placed over the printed circuit board. In particular, the radiator [110] and the flare [130] may be placed over the printed circuit board with the help of the feed point [140], the limb [120] and the shorting stub [150] and thereby, allowing a distance or a gap between these two components and the printed circuit board. Thus, the antenna [100] may occupy very minimal space on the printed circuit board.

The wireless device as used herein may include, but are not limited to, a mobile phone, a tablet, a phablet, a laptop, a desktop computer, a personal digital assistant (PDA), a dongle, a plain old telephone service device and any such device obvious to a person skilled in the art. Further, the wireless device may comprise an input means such as a keyboard, an operating system, a memory unit, a display interface, etc.

Figure 2A:
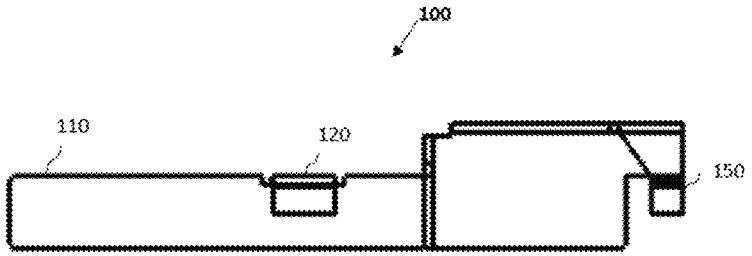
FIG. 2*a* illustrates a front view of the antenna [100], in accordance with an embodiment of the present invention.
Figure 2B:
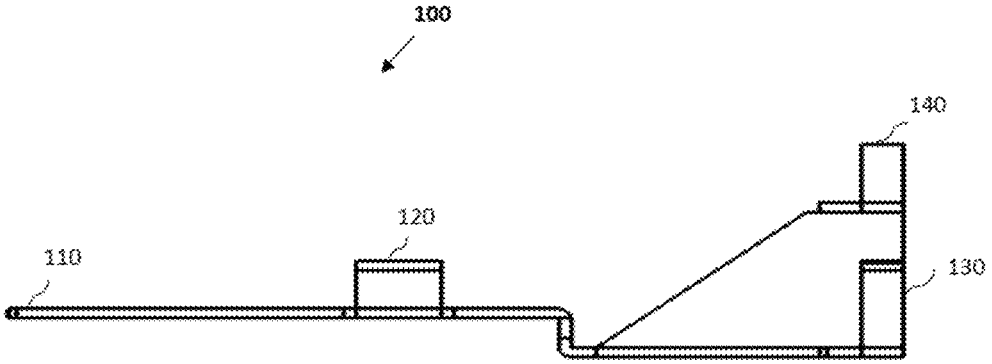
FIG. 2*b* illustrates a top view of the antenna [100], in accordance with an embodiment of the present invention.
Figure 2C:
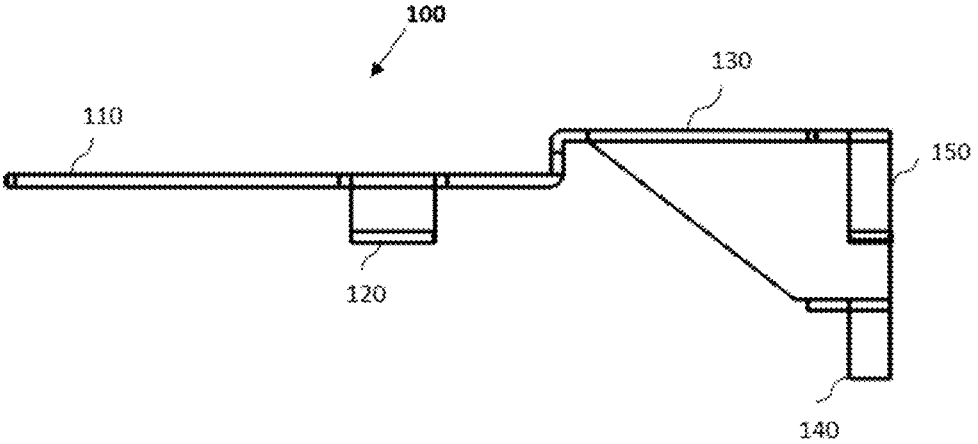
FIG. 2*c* illustrates a bottom view of the antenna [100], in accordance with an embodiment of the present invention.

As illustrated in FIG. 2*a*, the present invention illustrates a front view of the antenna [100], in accordance with an embodiment of the present invention. As illustrated in FIG. 2*b*, the present invention illustrates a top view of the antenna [100], in accordance with an embodiment of the present invention. As illustrated in FIG. 2*c*, the present invention illustrates a bottom view of the antenna [100], in accordance with an embodiment of the present invention. FIG. 2*a*, FIG. 2*b*, and FIG. 2*c* represents the various components of the antenna [100] such as the radiator [110], the limb [120], the flare [130], the feed point [140], and the shorting stub [150].

Figure 3:
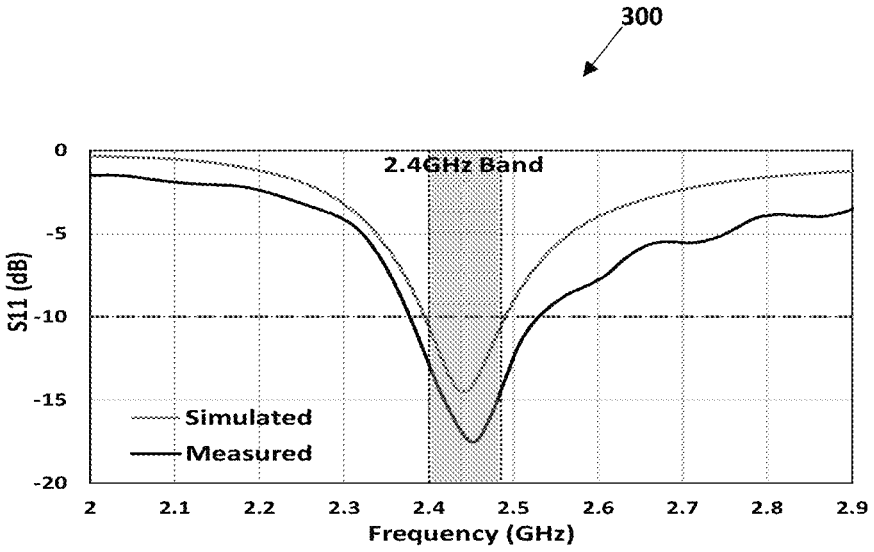
FIG. 3 illustrates an exemplary graph [300] representing simulated return loss versus measured return loss of the antenna [100], in accordance with an embodiment of the present invention.

As illustrated in FIG. 3, the present invention illustrates an exemplary graph [300] representing a simulated return loss versus a measured return loss of the antenna [100], in accordance with an embodiment of the present invention. The graph [300] may be a plot between a frequency (GHz) vs S11 (dB). The electrical performance for S-parameters and radiation patterns of the antenna [100] with the wireless device may be tested in an anechoic chamber. The electrical results may be matched with the simulation results. Further, the graph [300] may indicate that the result of the antenna [100] may achieve WLAN performance and meeting the desired specifications in a compact form factor.

Figure 4:
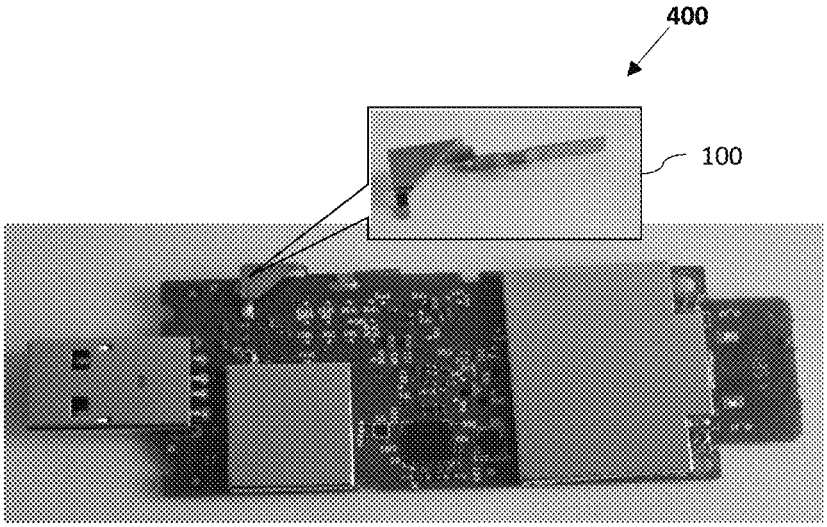
FIG. 4 illustrates an overall mounting of components [400] on the printed circuit board, in accordance with an embodiment of the present invention.

As illustrated in FIG. 4, the present invention illustrates an overall mounting of components [400] on the printed circuit board, in accordance with an embodiment of the present invention. As can be clearly seen in the FIG. 4, the overall mounting of the components [400] on the printed circuit board may include the mounting of the antenna [100]. Further, the antenna [100] may be placed at the edge or at any position and over the printed circuit board resulting in occupying minimal footprint area on the printed circuit board. In an embodiment, the placement of the antenna [100] may only occupy 1% to 2% of the footprint area of the printed circuit board, since the antenna [100] may only be connected with a few points on the printed circuit board and remaining body of the antenna may be in the air. Further, such placement of the antenna [100] at the edge of the printed circuit board or elsewhere may be known as 3D structure.

Figure 5:
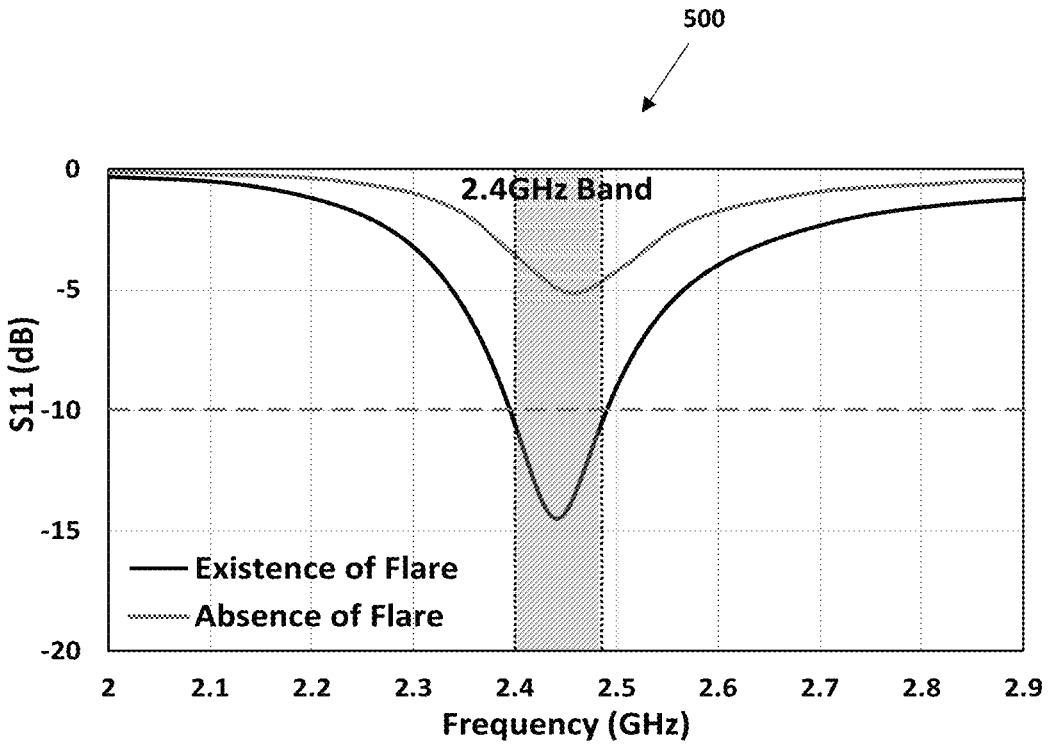
FIG. 5 illustrates an exemplary benchmark graph [500] of the flare [130] in the antenna [100], in accordance with an embodiment of the present invention.

As illustrated in FIG. 5, the present invention illustrates an exemplary benchmark graph [500] of the flare [130] in the antenna [100], in accordance with an embodiment of the present invention. The benchmark graph [500] as depicted may be a plot between a frequency (GHz) vs S11 (dB). As can be seen in the benchmark graph [500], the simulation results of the antenna [100] with flare [130] and without flare [130] structure may be compared. As can be read from the benchmark graph [500], the simulation result with the existence of the flare [130] may achieve the best simulation result. In particular, when feeding mechanism may be fed directly i.e. with no implementation of the flare [130], a return loss may be around −5 dB which means that there is no resonance but still operates in the wireless band. On the other hand, when incorporating the flare [130] at the feed point [140], a good impedance match may be achieved between the feed point [140] and the radiator [110] by improving the reflection coefficient significantly in the wireless band. Further, these simulation result may be studied using the CST microwave studio, electromagnetic (EM) simulation software or any other such simulation platform as obvious to a person skilled in the art, for the design and simulation of the antenna [100].

Figure 6:
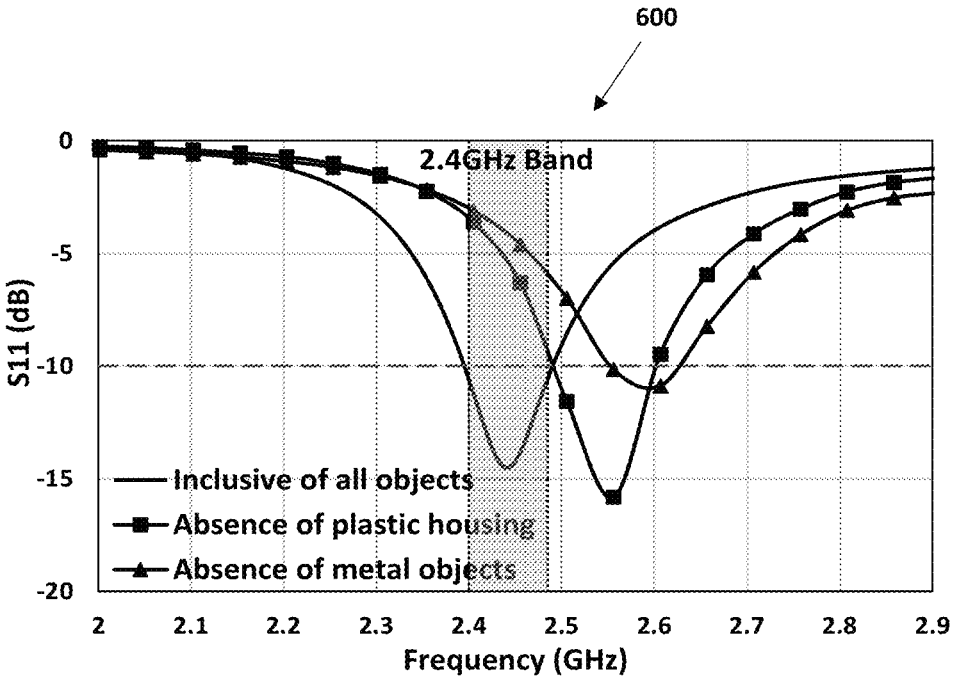
FIG. 6 illustrates an exemplary graph [600] representing performance effect of on-board metal components and a plastic housing in antenna [100], in accordance with an embodiment of the present invention.

As illustrated in FIG. 6, the present invention illustrates an exemplary graph [600] representing performance effect of an on-board metal components and the plastic housing in the antenna [100], in accordance with an embodiment of the present invention. The antenna [100] may be optimized to operate in the wireless band even in the presence of the nearby on-board metal components. The graph [600] as depicted may be a plot between a frequency (GHz) vs S11 (dB). As can be seen, a performance effect comparison is shown between the performance effect caused due to the absence of the plastic housing, the effect caused due to the absence of the nearby on-board metal components, and the effect caused due to the presence of both the plastic housing and the nearby on-board metal components. As depicted in the graph [600], the presence of both the plastic housing and the nearby on-board metal components may not reduce the performance of the antenna [100] and thus, may indicate the stability of operating frequency.

Figure 7:
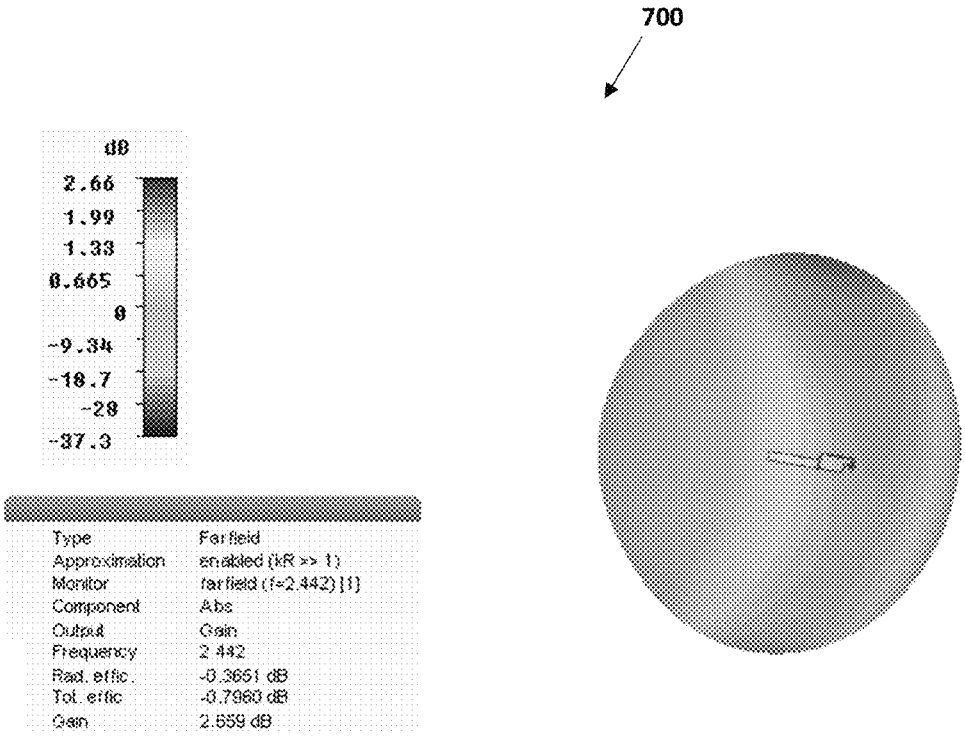
FIG. 7 illustrates 3D radiation pattern [700] of the antenna [100] at 2.4 GHz wireless operating frequency, in accordance with an embodiment of the present invention.

As illustrated in FIG. 7, the present invention illustrates 3D radiation pattern [700] of the antenna [100] at 2.4 GHz wireless operating frequency, in accordance with an embodiment of the present invention. As the flare [130] structure implemented in the antenna [100] may not reduce the performance of the antenna [100] due to the presence of the plastic housing and the nearby on-board metal components, the antenna [100] may radiate in an omnidirectional pattern [700]. FIG. 7 shows the 3D radiation pattern [700] at 2.4 GHz. Wi-Fi mid operating frequency. Thus, the antenna [100] may be capable of receiving arbitrary polarization angles at a constant level. Such a characteristic may alleviate polarization loss and may be an advantage for the wireless device. Further, such simulation may be performed using the CST microwave studio simulation software or any other such simulation platform as obvious to a person skilled in the art.

Figure 8A:
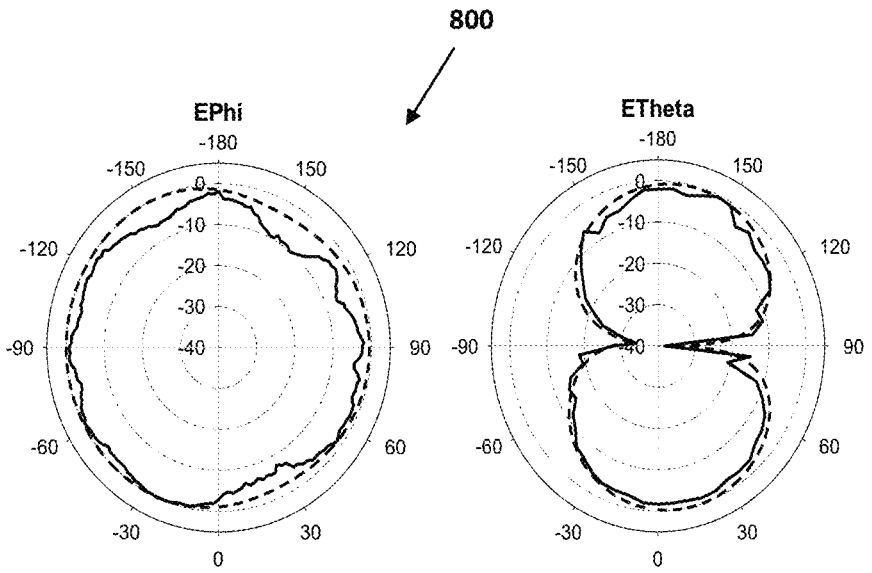
FIG. 8*a*-FIG. 8*c* illustrate radiation patterns [800] including a vertical (Eθ) and a horizontal (EΦ) polarization in an elevation cuts (XZ and YZ planes) and an azimuth cut (XY plane) of the antenna [100], in accordance with an embodiment of the present invention.
Figure 8B:
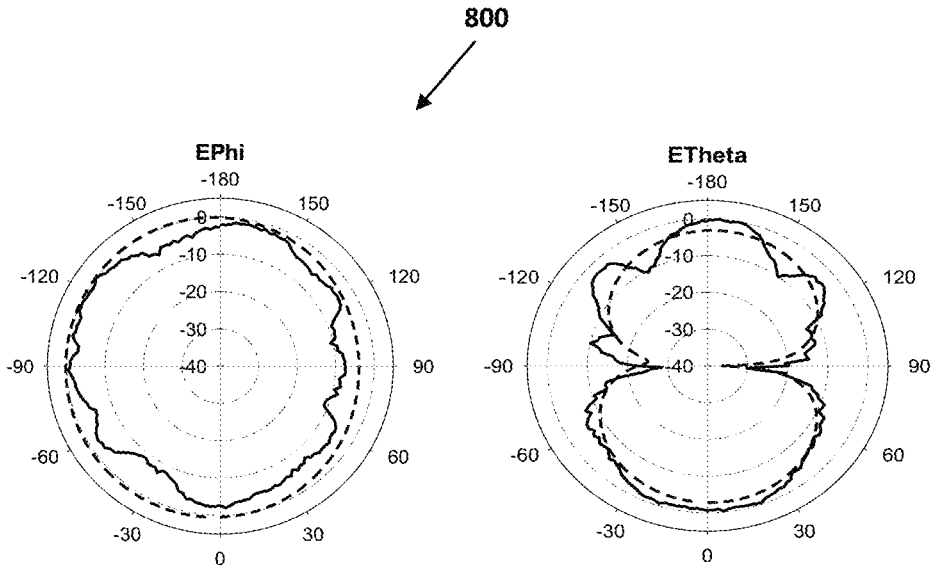
Figure 8C:
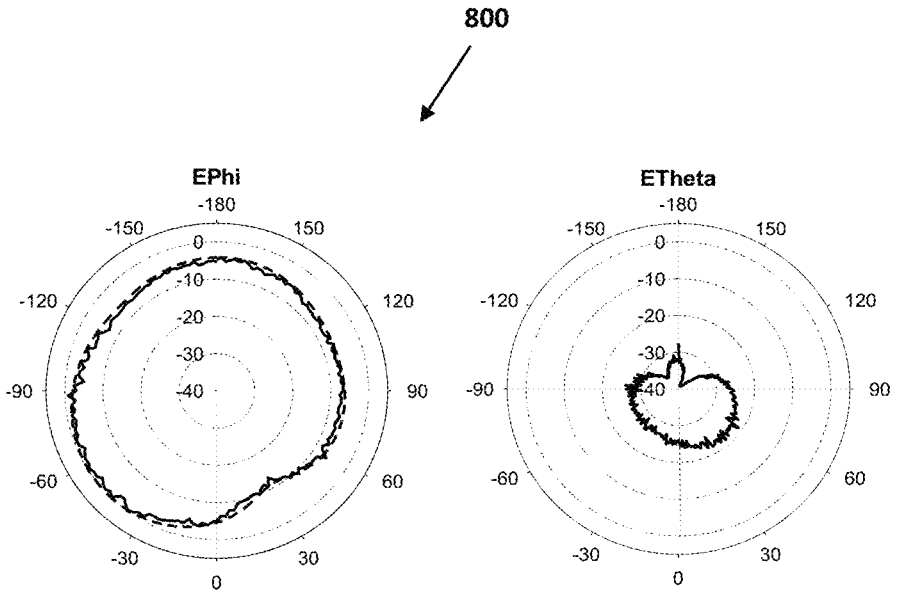

FIG. 8 illustrates radiation patterns [800] including a vertical (Eθ) and a horizontal (EΦ) polarization in an elevation cuts (XZ and YZ planes) and an azimuth cut (XY plane) of the antenna [100], in accordance with an embodiment of the present invention. In particular, FIG. 8*a* represents the radiation patterns for vertical (Eθ) polarization in the elevation cuts in XZ plane. FIG. 8*b* represents radiation patterns for the horizontal (EΦ) polarization in the elevation cuts in YZ plane. FIG. 8*c* represents radiation patterns for the azimuth cut in XY plane.

Figure 9:
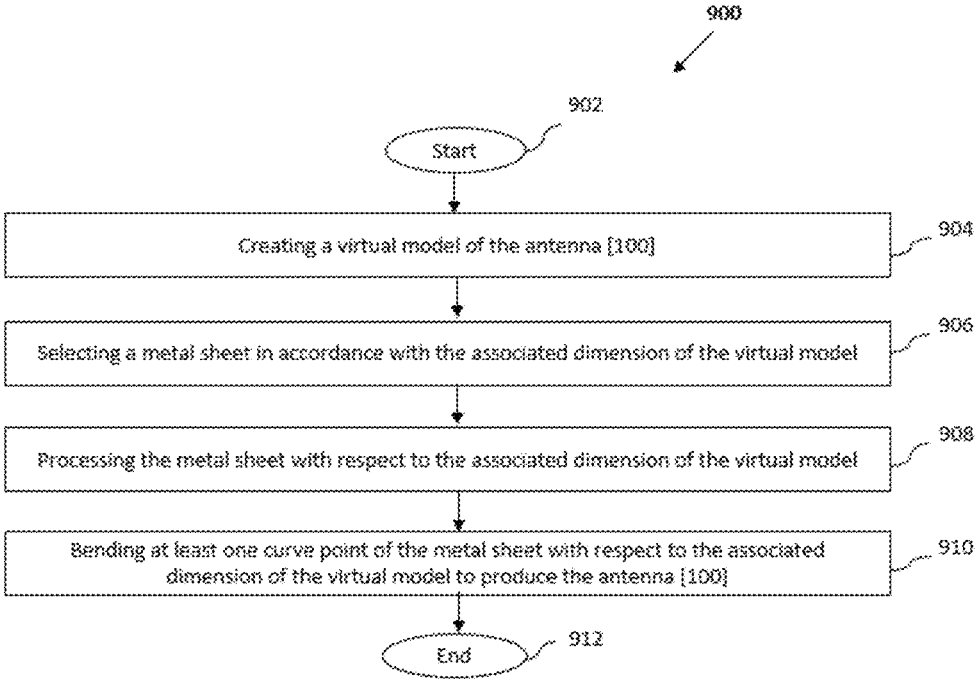
FIG. 9 illustrates an exemplary method flow diagram [900] for fabricating the antenna [100], in accordance with an embodiment of the present invention.

As illustrated in FIG. 9, the present invention encompasses an exemplary method flow diagram [900] for fabricating and/or manufacturing the antenna [100], in accordance with an embodiment of the present invention. The method flow may initiate at step 902.

At step 904, a virtual model of the antenna [100] may be created wherein the antenna [100] has the radiator [110], the limb [120], the flare [130], the feed point [140], and the shorting stub [150] connected integrally with each other. Further, each of the radiator [110], the limb [120], the flare [130], the feed point [140], and the shorting stub [150] may have an associated dimension. In an embodiment, the associated dimension of the virtual model of the antenna [100] may have one of a length, a width and a height. The associated dimensions of the antenna [100] may be captured from a design and/or simulation tool. Further, the virtual model of the antenna [100] may be one of a 2-dimensional model, a 3-dimensional model and any model that is obvious to a person skilled in the art.

At step 906, a metal sheet may be selected in accordance with the associated dimension of the virtual model. The metal sheet may have any 2-dimensional shape comprising one of a rectangular shape, a circular shape, and a triangle shape. Further, the metal sheet may be made-up of one of a beryllium copper, a phosphor bronze, and a nickel aluminium rectangular sheet.

At step 908, the metal sheet may be processed with respect to the associated dimension of the virtual model of the antenna [100], wherein the processing includes at least one of an etching, cutting, punching and shaping the metal sheet.

At step 910, the antenna [100] may be produced using a die and by bending at least one curve point of the metal sheet with respect to the associated dimension of the virtual model of the antenna [100]. The antenna [100] may be ready to mount over the printed circuit board for assembly. Then, the method [900] may end at step 912.

Figure 10A:
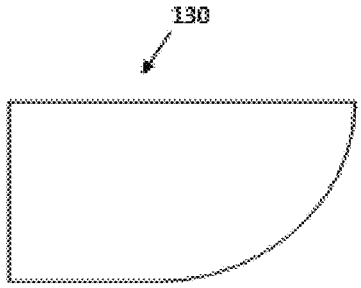
FIG. 10*a*, FIG. 10*b* and FIG. 10*c* illustrates an exemplary structure of the flare [130], in accordance with yet another alternative embodiment of the present invention.
Figure 10B:
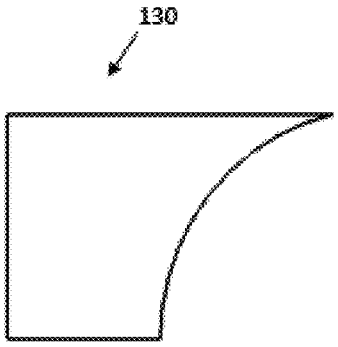
Figure 10C:
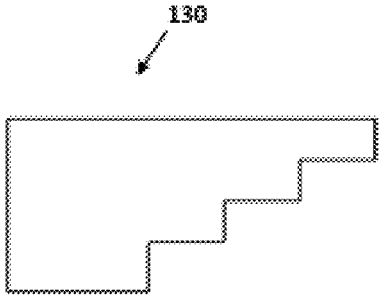

FIG. 10*a*, FIG. 10*b* and FIG. 10*c* illustrates an exemplary structure of the flare [130], in accordance with yet another alternative embodiment of the present invention. FIG. 10*a*, FIG. 10*b* and FIG. 10*c* represents different shapes and/or structure of the flare [130] which may be taper-shaped from the first end of the flare [130] to the second end of the flare [130] and may have the width which decreases from the first end of the flare [130] to the second end of the flare [130], one of a linearly and a non-linearly.

Though a limited number of antenna [100], the radiator [110], the limb [120] the flare [130], the feed point [140], and the shorting stub [150], have been shown in the figures; however, it will be appreciated by those skilled in the art that the antenna [100] of the present invention encompasses any number and varied types of the entities/elements such as antenna [100], the radiator [110], the limb [120] the flare [130], the feed point [140], and the shorting stub [150].

While considerable emphasis has been placed herein on the disclosed embodiments, it will be appreciated that many embodiments can be made and that many changes can be made to the embodiments without departing from the principles of the present invention. These and other changes in the embodiments of the present invention will be apparent to those skilled in the art, whereby it is to be understood that the foregoing descriptive matter to be implemented is illustrative and non-limiting.

We claim:

1. An antenna for matching an impedance between a feed point and a radiator, the antenna comprising:

the radiator mounted over a printed circuit board for one of receiving and transmitting a radio signal, wherein the radiator has a first end and a second end, and the length of the radiator determines an operating frequency of the antenna;

a flare placed at one of the first end and the second end of the radiator for matching impedance, wherein the flare has a first end and a second end, and the flare is taper-shaped from the first end to the second end of the flare;

the feed point comprises a first end and a second end, wherein the first end of the feed point is connected to the second end of the flare, and the second end of the feed point is connected to the printed circuit board; and a shorting stub placed between the flare and the printed circuit board for grounding a capacitance induced by the antenna.

2. The antenna as claimed in claim 1, further comprises a limb for providing mechanical stability to the antenna.

3. The antenna as claimed in claim 2, wherein the limb has a first end connected to the radiator and a second end connected to the printed circuit board.

4. The antenna as claimed in claim 3, wherein the radiator is mounted over the printed circuit board by at least one of the feed point, the shorting stub, and the limb.

5. The antenna as claimed in claim 1, wherein the radiator is configured to radiate in an omni-directional pattern in presence of surrounding one or more metal objects.

6. The antenna as claimed in claim 1, the taper-shape includes one of a linear and a non-linear decrease in a width from the first end of the flare to the second end of the flare.

7. The antenna as claimed in claim 1, wherein the antenna is configured to operate on a variable frequency band.

8. The antenna as claimed in claim 1, wherein the antenna is a flare fed inverted F antenna (FFIFA) type.

9. The antenna as claimed in claim 1, wherein the antenna is configured to receive arbitrary polarization angles at a constant level.

10. A method for manufacturing an antenna for impedance matching, the method comprises: creating a virtual model of the antenna, wherein the antenna has a radiator, a limb, a flare, a feed point, and a shorting stub connected integrally with each other, each of the radiator, the limb, the flare, the feed point, and the shorting stub have an associated dimension the radiator is mounted over a printed circuit board for one of receiving and transmitting a radio signal wherein the radiator has a first end and a second end, and the length of the radiator determines an operating frequency of the antenna; the flare is placed at one of the first end and the second end of the radiator for matching impedance, wherein the flare has a first end and a second end, and the flare is taper-shaped from the first end to the second end of the flare, the feed point comprises a first end and a second end, wherein the first end of the feed point is directly connected to the second end of the flare, and the second end of the feed point is directly connected to the printed circuit board, and a shorting stub placed between the flare and the printed circuit board for grounding a capacitance induced by the antenna; selecting a metal sheet in accordance with the associated dimension of the virtual model; processing the metal sheet in accordance with the associated dimension of the virtual model wherein the processing includes at least one of a punching, etching, cutting and shaping the metal sheet; and bending at least one curve point of the metal sheet with respect to the associated dimension of the virtual model to produce the antenna.

11. The method as claimed in claim 10, wherein the associated dimension includes at least one of a length, a width and a height.

12. The method as claimed in claim 10, wherein the metal sheet is made up of one of a beryllium copper, a phosphor bronze, and a nickel aluminium.

13. The method as claimed in claim 10, wherein the metal sheet has a 2-dimensional shape.

* * * * *